US009037359B2

(12) United States Patent
Taylor et al.

(10) Patent No.: US 9,037,359 B2
(45) Date of Patent: May 19, 2015

(54) SYSTEM AND METHOD FOR DETERMINING SADDLE BLOCK SHIMMING GAP OF AN INDUSTRIAL MACHINE

(71) Applicant: Harnischfeger Technologies, Inc., Wilmington, DE (US)

(72) Inventors: Wesley P. Taylor, Glendale, WI (US); Charles D. Payne, Mukwonago, WI (US)

(73) Assignee: Harnischfeger Technologies, Inc., Wilmington, DE (US)

( * ) Notice: Subject to any disclaimer, the term of this patent is extended or adjusted under 35 U.S.C. 154(b) by 297 days.

(21) Appl. No.: 13/754,331

(22) Filed: Jan. 30, 2013

(65) Prior Publication Data

US 2013/0197711 A1 Aug. 1, 2013

Related U.S. Application Data

(60) Provisional application No. 61/593,049, filed on Jan. 31, 2012.

(51) Int. Cl.

| | |
|---|---|
| ***E02F 3/30*** | (2006.01) |
| ***E02F 9/20*** | (2006.01) |
| ***E02F 9/26*** | (2006.01) |
| ***E02F 3/46*** | (2006.01) |

(52) U.S. Cl.

CPC ..... *E02F 9/2025* (2013.01); *E02F 9/264* (2013.01); *E02F 3/304* (2013.01); *E02F 3/46* (2013.01); *E02F 9/267* (2013.01)

(58) Field of Classification Search

CPC ..... E02F 3/304; E02F 3/435; E02F 3/46; E02F 9/264; E02F 9/267; E02F 9/2025

USPC ..... 701/1, 34.4, 50

See application file for complete search history.

(56) References Cited

U.S. PATENT DOCUMENTS

| | | | | |
|---|---|---|---|---|
| 2,211,194 | A | 8/1940 | Baker | |
| 5,408,767 | A * | 4/1995 | Hazama et al. | 37/396 |
| 6,025,686 | A * | 2/2000 | Wickert et al. | 318/568.18 |
| 7,222,051 | B2 | 5/2007 | Shibata et al. | |
| 7,734,397 | B2 * | 6/2010 | Peterson et al. | 701/50 |
| 7,950,171 | B2 | 5/2011 | Wurster | |
| 8,843,279 | B2 * | 9/2014 | Tafazoli Bilandi et al. | 701/50 |

(Continued)

OTHER PUBLICATIONS

First Australian Examination Report for Australian Application No. 2013200546 dated Jul. 14, 2014 (6 pages).

*Primary Examiner* — Helal A Algahaim

*Assistant Examiner* — Donald J Wallace

(74) *Attorney, Agent, or Firm* — Michael Best & Friedrich LLP

(57) ABSTRACT

A method of controlling the operation of an industrial machine. The industrial machine includes a boom, a dipper handle attached to the boom, a saddle block pivotally mounted to the boom at a pivot point, and a computer having a controller. The method comprises processing, with the controller, data received from a saddle angle sensor, determining, with the controller, a saddle angle and a saddle angle gap using the data from the saddle angle sensor, determining, with the controller, a height of the dipper handle. The method further comprises determining, with the controller, a height of the saddle block, determining, with the controller, a saddle gap radius, and determining, with the controller, a saddle block shimming gap by comparing the saddle gap radius with the height of the handle.

20 Claims, 5 Drawing Sheets

(56) References Cited

U.S. PATENT DOCUMENTS

2007/0266601 A1* 11/2007 Claxton ..... 37/396
2009/0018718 A1 1/2009 Lang et al.
2009/0265064 A1 10/2009 Furuno
2010/0283675 A1 11/2010 McAree et al.
2011/0029279 A1 2/2011 McAree et al.
2011/0311342 A1* 12/2011 Montgomery ..... 414/685
2014/0336870 A1* 11/2014 Claxton ..... 701/31.9

* cited by examiner

SYSTEM AND METHOD FOR DETERMINING SADDLE BLOCK SHIMMING GAP OF AN INDUSTRIAL MACHINE

CROSS-REFERENCE TO RELATED APPLICATIONS

This application claims priority to U.S. Provisional Application No. 61/593,049, filed on Jan. 31, 2012, which is incorporated herein by reference in its entirety.

BACKGROUND

The present invention relates to power shovels and, more particularly, to power shovels having a dipper for excavating material. More specifically, the present invention relates to saddle block assemblies that support the dipper handle or arm.

SUMMARY

In the mining field, and in other fields in which large volumes of materials must be collected and removed from a work site, it is typical to employ industrial machines including a large dipper for shoveling the materials from the work site. Industrial machines, such as electric rope or power shovels, draglines, etc., are used to execute digging operations to remove material from, for example, a bank of a mine. After filling the dipper with material, the machine swings the dipper to the side to dump the material into a material handling unit, such as a dump truck or a local handling unit (e.g., crusher, sizer, or conveyor). Electric rope shovels typically include a shovel boom, a handle pivotally extending from the boom and supporting the dipper, and a sheave or pulley rotatably supported on the boom. A hoist rope extends around the sheave or pulley and is connected to the shovel dipper to raise and lower the dipper, thereby producing an efficient digging motion to excavate the bank of material. The handle is usually attached to the boom by using saddle block assemblies mounted on the shipper shaft. The saddle block assemblies are used to keep the handle in a proper position while the shovel is operating.

During operation of the shovel, forces in the vertical and the horizontal directions are applied on the shovel's handle. The vertical force is a result of the digging loads and the separating force between the gear racking on the handle and the crowd pinion. The horizontal force is due to the machine swinging, digging loads, and to the inertia created during the operation of the shovel. The purpose of the saddle block assemblies is to withstand these forces and keep the handle in position relative to the boom. The relative motion between the components causes wear on the surfaces of the saddle block that are in contact with the handle. For that reason, the saddle block assemblies further include replaceable wear plates. The wear plates are much less expensive and easier to maintain and replace than an entire saddle block assembly.

Generally, there is a gap between the dipper handle and the saddle blocks that hold the handle to the dipper. The saddle block wear plates need to be adjusted on a regular basis to maintain the correct gap between the components. Rather than replacing the wear plates at every adjustment, the wear plates are repositioned to increase their service life. In some embodiments, metal shims are installed between the wear plates and the saddle block assembly to maintain the proper operating gap. This saddle block shimming gap is necessary, because if the saddle blocks are connected too close to the handle they can cause increased friction and wear on the handle.

For best operation of the shovel, this gap between the saddle blocks and the handle should be very small (e.g., between 0.125 inches and 0.5 inches). However, during the extended operation of the shovel, the saddle block shimming gap increases progressively. If the gap increases beyond specific parameters, the shovel begins to experience various problems that lead to poor shovel performance. First, the increased gap between the saddle blocks and the handle contributes to large shock loads as the parts of the shovel move. Second, a large gap allows the handle racking and the crowd pinion to separate from each other. This greatly increases the load on the gear teeth leading to broken gear teeth, rough operation, and increased noise.

Therefore, it is very important to be able to quickly and accurately determine the existing saddle block shimming gap in a power shovel. Current maintenance routines for conventional shovels require visual inspection of the saddle blocks and a standard assumption on a wear rate. Thus, an automated, more precise determination of the saddle block shimming gap will provide better maintenance feedback and will improve the overall performance of the shovel. The described invention seeks to provide a control system and a method that can determine the saddle block shimming gap of an electric rope shovel. The proposed method uses sensor data and linear calculations to determine the saddle angle (i.e., the angle that the saddle block is currently at with respect to the shovel or the shovel's boom) and a saddle angle gap. Then, by using information about the height of the dipper handle and the height of the saddle block, the method finds the saddle angle gap radius that is used to determine the saddle block shimming gap.

In one embodiment, the invention provides a method of controlling the operation of an industrial machine. The industrial machine includes a boom, a dipper handle attached to the boom, a saddle block pivotally mounted to the boom at a pivot point, and a computer having a controller. The method comprises processing, with the controller, data received from a saddle angle sensor, determining, with the controller, a saddle angle and a saddle angle gap using the data from the saddle angle sensor, determining, with the controller, a height of the dipper handle. The method further comprises determining, with the controller, a height of the saddle block, determining, with the controller, a saddle gap radius, and determining, with the controller, a saddle block shimming gap by comparing the saddle gap radius with the height of the handle.

In another embodiment, the invention provides an industrial machine. The machine includes a boom, a dipper handle attached to the boom, a saddle block pivotally mounted to the boom at a pivot point, and a computer having a controller. The controller executes programmed instructions to process data received from a saddle angle sensor, determine a saddle angle and a saddle angle gap using the data from the saddle angle sensor, determine a height of the dipper handle, determine a height of the saddle block, determine a saddle gap radius, and determine a saddle block shimming gap by comparing the saddle gap radius with the height of the handle.

In yet another embodiment, the invention provides a method of controlling the operation of an industrial machine. The industrial machine includes a boom, a dipper handle attached to the boom, a saddle block pivotally mounted to the boom at a pivot point, and a computer having a controller. The method includes processing, with the controller, data received from a saddle angle sensor, determining, with the controller, a saddle angle and a saddle angle gap using the data from the saddle angle sensor, determining, with the controller, when the saddle block shifts above or below a horizontal plane of the pivot point, storing, with the controller, sensor angle data immediately before and after the shift of the saddle block. The method also includes determining an average saddle angle velocity at the horizontal plane at the time the saddle block shifted, creating a linear approximation of the saddle angle position by using the average saddle angle velocity and the sensor angle data before and after the saddle block shift, determining, with the controller, a height of the dipper handle. The method further includes determining, with the controller, a height of the saddle block, determining, with the controller, a saddle gap radius, and determining, with the controller, the saddle block shimming gap by comparing the saddle gap radius with the height of the handle.

DETAILED DESCRIPTION

Figure 1:
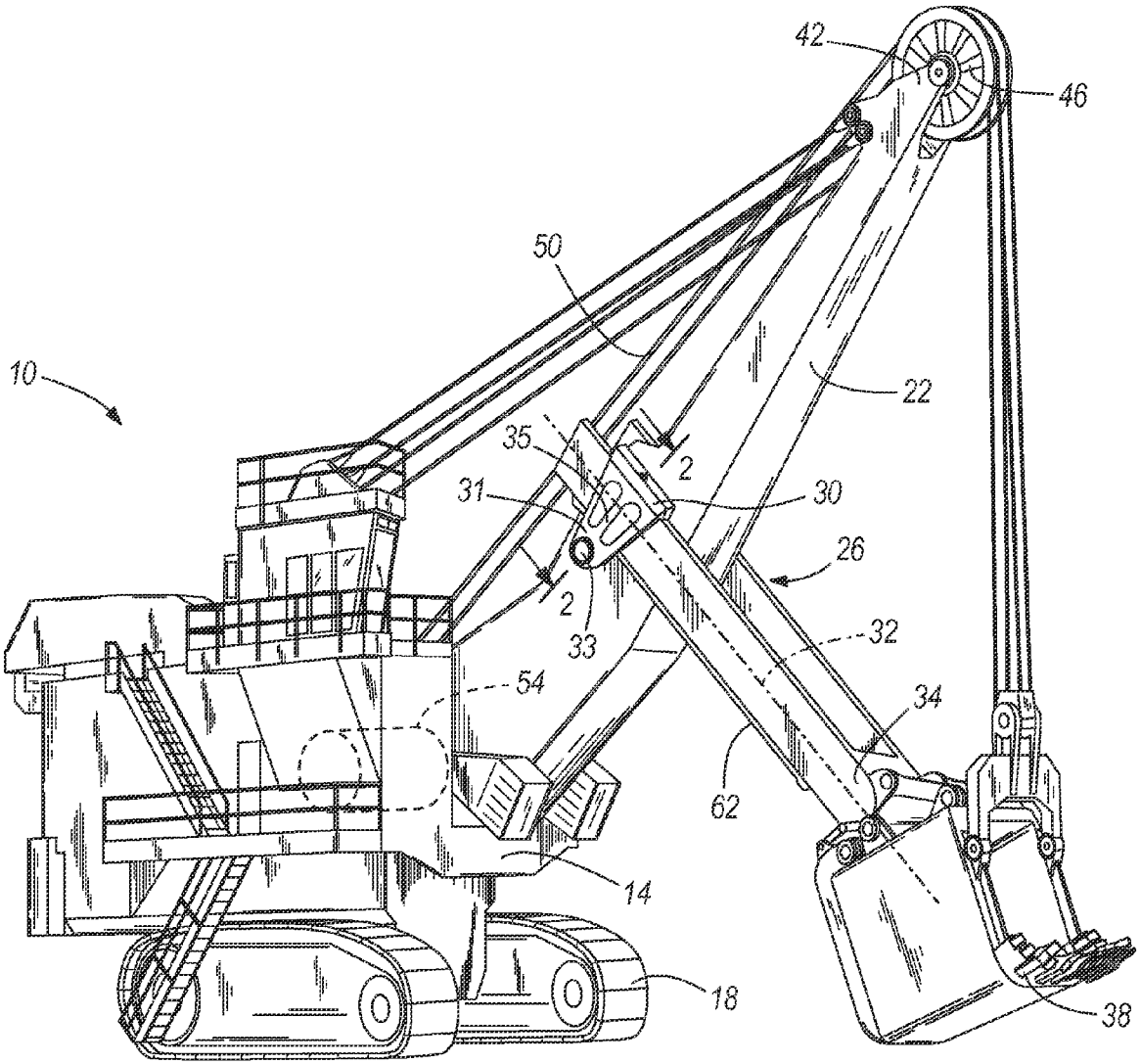
FIG. 1 illustrates an industrial machine according to an embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, and can include electrical connections or couplings, whether direct or indirect. Also, electronic communications and notifications may be performed using any known means including direct connections, wireless connections, etc.

It should also be noted that a plurality of hardware and software based devices, as well as a plurality of different structural components may be used to implement the invention. In addition, it should be understood that embodiments of the invention may include hardware, software, and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software (e.g., stored on non-transitory computer-readable medium) executable by one or more processors. As such, it should be noted that a plurality of hardware and software based devices, as well as a plurality of different structural components may be utilized to implement the invention. Furthermore, and as described in subsequent paragraphs, the specific mechanical configurations illustrated in the drawings are intended to exemplify embodiments of the invention and that other alternative mechanical configurations are possible. For example, "controllers" described in the specification can include standard processing components, such as one or more processors, one or more computer-readable medium modules, one or more input/output interfaces, and various connections (e.g., a system bus) connecting the components.

The invention described herein relates to systems, methods, devices, and computer readable media associated with the precise determination of a saddle block shimming gap of an industrial machine. The industrial machine, such as an electric rope shovel or similar mining machine, is operable to execute a digging operation to remove a payload (i.e. material) from a bank. During the operation of the machine, the handle of the machine is frequently crowding or retracting in order to dig in the bank of the material or to swing the machine. The motion between the components of the machine causes wear to the saddle block (and its elements) that supports the handle during the operation of the machine. An increased saddle block shimming gap can contribute to large shock loads and stresses that can adversely affect the operational life of the industrial machine.

In order to quickly and accurately determine the exact saddle block shimming gap without discontinuing the operation of the machine, a controller of the industrial machine uses the information received from a sensor (e.g., an inclinometer) to determine a saddle angle that is then used to calculate the saddle block shimming gap of the machine. The saddle angle is the angle that the saddle block is currently at with respect to the shovel. Specifically, the controller uses sensor data and linear calculations to determine the saddle angle and a saddle angle gap (e.g., data from an inclinometer in the saddle block is compared with data from an inclinometer in the base of the shovel to determine the saddle angle). Then, the controller uses information about the height of the dipper handle and the height of the saddle block to find the saddle angle gap radius that is used to determine the saddle block shimming gap. Determining the saddle block shimming gap of the industrial machine in such a manner improves the measurement of the dipper position and provides accurate feedback as to when the saddle block shims need to be adjusted or replaced.

Controlling the industrial machine and determining the saddle block shimming gap includes determining, among other things, the orientation of the industrial machine, the position of the components of the industrial machine, and relative angles of the components of the industrial machine with respect to one another. For example, the industrial machine can include one or more inclinometers (e.g., a saddle angle sensor) that can be used to determine the inclination of, for example, a saddle block, a dipper handle, a boom, or another component of the industrial machine. The inclination of the component of the industrial machine can be used by a variety of control systems associated with the industrial machine for the purpose of collision avoidance, payload determination, position detection, etc. In one embodiment, the inclinometers can include an array of magnets (e.g., permanent magnets) mounted or otherwise coupled to a component of the industrial machine. A circular magnetic sensor array (e.g., an array of Hall Effect sensors or other magnetic detectors) is provided proximately to the magnets. The sensor array detects a characteristic (e.g., magnetic flux) associated with the magnets and is connected to a controller that receives signals from the magnetic sensor array related to the characteristic. The controller then processes the signals received from the sensor array. Based on which sensors in the sensor array detected the characteristic associated with the magnets, the controller determines or calculates an inclination of the component of the industrial machine. Such an inclinometer is capable of determining the inclination of the component of the industrial machine based on linear movements of the component, rotational movements of the component, or a combination of linear and rotational movements of the component of the industrial machine. It is to be understood, that any other types of inclinometers can also be used in the operation of the industrial machine.

Although the invention described herein can be applied to, performed by, or used in conjunction with a variety of industrial machines (e.g., a rope shovel, a dragline with hoist and drag motions, hydraulic machines, etc.), embodiments of the invention described herein are described with respect to an electric rope or power shovel, such as the power shovel 10 shown in FIG. 1. The power shovel 10 includes a mobile frame 14 supported for movement over the ground, drive tracks 18, a boom 22, a dipper handle 26, a saddle block and rack and pinion crowd drive mechanism 30, a saddle block 31, a pivot point 33, a dipper 38, a sheave 46, a hoist cable 50, a winch drum 54, and a saddle angle sensor or inclinometer 35. In the illustrated embodiment, the winch drum 54 is covered by a hosing of the shovel 10.

The mobile frame 14 is a revolvable housing mounted on a mobile base such as the drive tracks 18. The fixed boom 22 extends upwardly and outwardly from the frame 14. The dipper handle 26 is mounted on the boom 22 for movement about the saddle block and rack and pinion crowd drive mechanism 30. The dipper handle 26 is operable for pivotal movement relative to the boom 22 about a generally horizontal dipper handle axis 32. Further, the dipper handle 26 is operable for translational (non-pivotable) movement relative to the boom 22. The dipper handle 26 has a forward end 34. The dipper 38 is mounted on the forward end 34 of the dipper handle 26. An outer end 42 of the boom 22 has thereon a sheave 46. A hoist cable(s) or rope(s) 50 extends over the sheave 46 from a winch drum 54 mounted on the frame 14.

The dipper 38 is suspended from the boom 22 by the hoist rope(s) 50. The hoist rope 50 is wrapped over the sheave 46 and attached to the dipper 38 at a bail pin. The hoist rope 50 is anchored to the winch drum 54 of the mobile frame 14. As noted above, in the illustrated embodiment, the winch drum 54 is covered by a hosing of the shovel 10. As the winch drum 54 rotates, the hoist rope 50 is paid out to lower the dipper 38 or pulled in to raise the dipper 38. The dipper 38 also includes the dipper handle or dipper arm 26 rigidly attached thereto. The dipper arm 26 is slidably supported in the saddle block 31 of the saddle block and rack and pinion crowd drive mechanism 30. The saddle block 31 is pivotally mounted to the boom 22 at the pivot point 33. The dipper handle 26 includes a rack tooth formation thereon which engages a drive pinion mounted in the saddle block 31. The drive pinion is driven by an electric motor and transmission unit (not shown) to extend or retract the dipper arm 26 relative to the saddle block 31.

An electrical power source (not shown) is mounted to the mobile frame 14 to provide power to one or more electric hoist motors to drive the winch drum 54, one or more electric crowd motors to drive the saddle block transmission unit, and one or more electric swing motors to turn the mobile frame 14. Each of the crowd, hoist, and swing motors are driven by its own motor controller or drive in response to control voltages and currents corresponding to operator commands.

Figure 2:
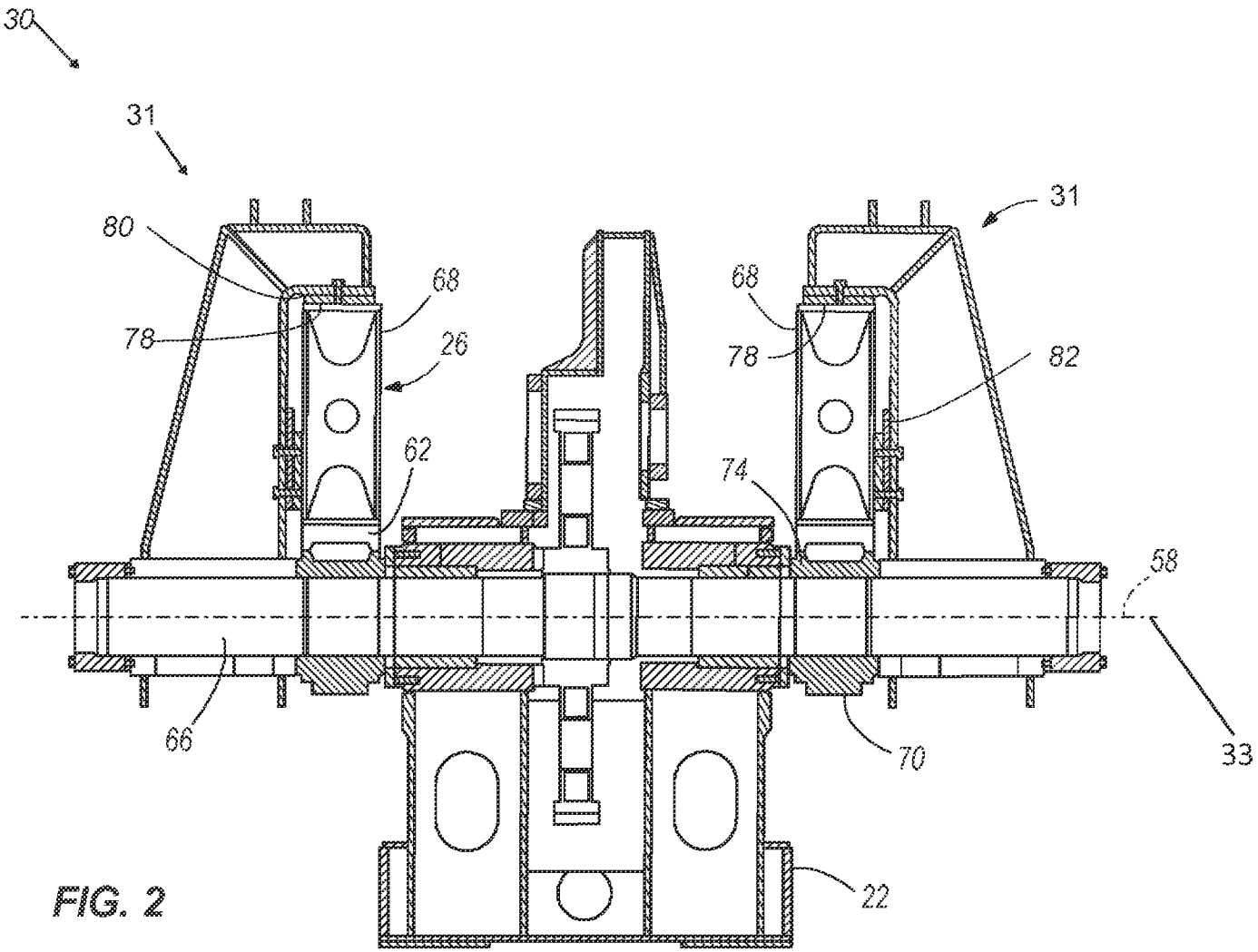
FIG. 2 is a cut view of the saddle block and rack and pinion crowd drive mechanism of FIG. 1, taken along the line 2-2 in FIG. 1.

FIG. 2 illustrates the saddle block and rack and pinion crowd drive mechanism 30 in more detail. It should be understood that the present invention is capable of using other types of saddle blocks and the saddle blocks 31 are only shown as one possible example. In some embodiments, the handle 26 of the shovel 10 comprises two legs 68 that are positioned on either side of the boom 22. The handle 26 also includes gear racking 62 attached to the bottom of each leg 68. A shipper shaft 66 having an axis 58 is also mounted horizontally through the boom 22 to secure the saddle block assemblies 31 in place. Two pinions 70 with splines 74 are attached to the shipper shaft 66. The gear racking 62 on the handle legs 68 engages the pinion gear splines 74. An electric motor and a transmission (not shown) rotate the shipper shaft and pinions, thus causing the handle and racking to crowd and retract from the boom. The entire saddle block assembly helps maintain the proper position of the handle 26 during operation of the shovel.

The saddle block assemblies 31 include replaceable wear plates 78. During routine maintenance of the shovel 10, the wear plates 78 are easier to replace than an entire saddle block assembly. For example, after the wear plates 78 have reached a certain thickness, they are discarded and new ones are installed. This leaves the integrity of the saddle block assemblies intact. As mentioned above, the saddle block wear plates 78 need to be adjusted on a regular basis to maintain the correct gap between the components of the shovel. In some embodiments, instead of disposing the wear plates 78 at every adjustment, they are repositioned to increase their service life. Metal shims 80 and 82 are installed between the wear plates 78 and the saddle block assembly to maintain the proper operating gap between the saddle block 31 and the handle 26.

Figure 3:
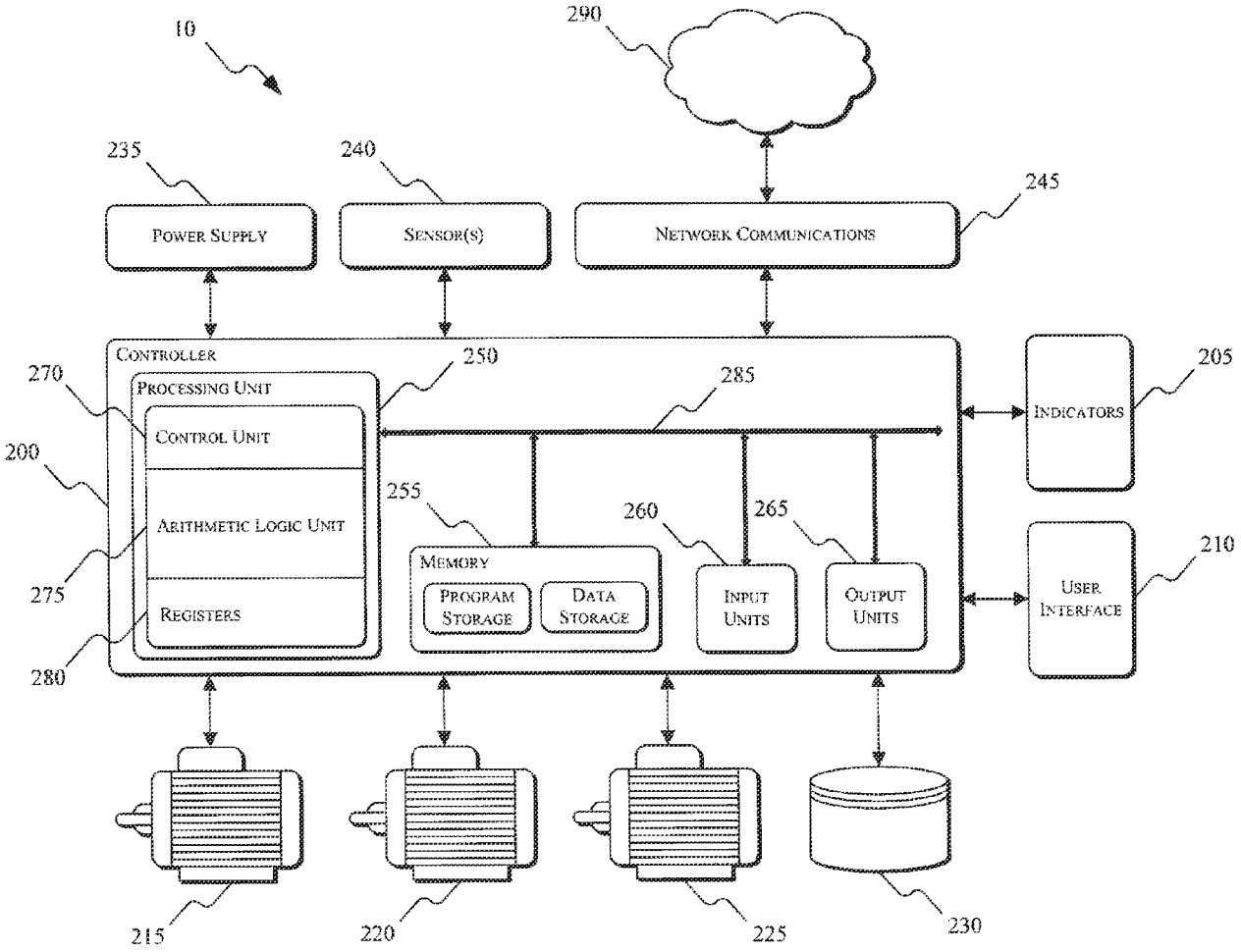
FIG. 3 illustrates a controller for an industrial machine according to an embodiment of the invention.

FIG. 3 illustrates a controller 200 associated with the power shovel 10 of FIG. 1. It is to be understood that the controller 200 can be used is a variety of industrial machines besides the shovel 10 (e.g., a dragline, hydraulic machines, construction machines, etc.). The controller 200 is in communication with a variety of modules or components of the shovel 10. For example, the illustrated controller 200 is connected to one or more indicators 205, a user interface module 210, one or more hoist motors and hoist motor drives 215, one or more crowd motors and crowd motor drives 220, one or more swing motors and swing motor drives 225, a data store or database 230, a power supply module 235, one or more sensors 240, and a network communications module 245. The controller 200 includes combinations of hardware and software that are operable to, among other things, control the operation of the power shovel 10, control the position of the boom 22, the dipper arm 26, the dipper 38, etc., activate the one or more indicators 205 (e.g., a liquid crystal display ["LCD"]), monitor the operation of the shovel 10, etc. The one or more sensors 240 include, among other things, position sensors, velocity sensors, speed sensors, acceleration sensors, the inclinometer 35, one or more motor field modules, etc. For example, the position sensors are configured to detect the position of the shovel 10, the position of the dipper handle 26 and the dipper 38 and to provide the information to the controller 200. Further, the inclinometer 35 is configured to detect the position of the handle 26 in relation to the saddle blocks 31 and to provide that information to the controller 200.

In some embodiments, the controller 200 includes a plurality of electrical and electronic components that provide power, operational control, and protection to the components and modules within the controller 200 and/or shovel 10. For example, the controller 200 includes, among other things, a processing unit 250 (e.g., a microprocessor, a microcontroller, or another suitable programmable device), a memory 255, input units 260, and output units 265. The processing unit 250 includes, among other things, a control unit 270, an arithmetic logic unit ("ALU") 275, and a plurality of registers 280 (shown as a group of registers in FIG. 2), and is implemented using a known computer architecture. The processing unit 250, the memory 255, the input units 260, and the output units 265, as well as the various modules connected to the controller 200 are connected by one or more control and/or data buses (e.g., common bus 285). The control and/or data buses are shown generally in FIG. 3 for illustrative purposes. The use of one or more control and/or data buses for the interconnection between and communication among the various modules and components would be known to a person skilled in the art in view of the invention described herein. In some embodiments, the controller 200 is implemented partially or entirely on a semiconductor (e.g., a field-programmable gate array ["FPGA"] semiconductor) chip, such as a chip developed through a register transfer level ("RTL") design process.

The memory 255 includes, for example, combinations of different types of memory, such as read-only memory ("ROM"), random access memory ("RAM") (e.g., dynamic RAM ["DRAM"], synchronous DRAM ["SDRAM"], etc.), electrically erasable programmable read-only memory ("EEPROM"), flash memory, a hard disk, an SD card, or other suitable magnetic, optical, physical, or electronic memory devices. The processing unit 250 is connected to the memory 255 and executes software instructions that are capable of being stored in a RAM of the memory 255 (e.g., during execution), a ROM of the memory 255 (e.g., on a generally permanent basis), or another non-transitory computer readable medium such as another memory or a disc. Software included in the implementation of the shovel 10 can be stored in the memory 255 of the controller 200. The software includes, for example, firmware, one or more applications, program data, filters, rules, one or more program modules, and other executable instructions. The controller 200 is configured to retrieve from memory and execute, among other things, instructions related to the control processes and methods described herein. In other constructions, the controller 200 includes additional, fewer, or different components.

The network communications module 245 is connectable to and can communicate through a network 290. In some embodiments, the network is, for example, a wide area network ("WAN") (e.g., a TCP/IP based network, a cellular network, such as, for example, a Global System for Mobile Communications ["GSM"] network, a General Packet Radio Service ["GPRS"] network, a Code Division Multiple Access ["CDMA"] network, an Evolution-Data Optimized ["EV-DO"] network an, Enhanced Data Rates for GSM Evolution ["EDGE"] network, a 3GSM network, a 4GSM network, a Digital Enhanced Cordless Telecommunications ["DECT"] network, a Digital AMPS ["IS-136/TDMA"] network, or an Integrated Digital Enhanced Network ["iDEN"] network, etc.).

In other embodiments, the network 290 is, for example, a local area network ("LAN"), a neighborhood area network ("NAN"), a home area network ("HAN"), or personal area network ("PAN") employing any of a variety of communications protocols, such as Wi-Fi, Bluetooth, ZigBee, etc. Communications through the network 290 by the network communications module 245 or the controller 200 can be protected using one or more encryption techniques, such as those techniques provided in the IEEE 802.1 standard for port-based network security, pre-shared key, Extensible Authentication Protocol ("EAP"), Wired Equivalency Privacy ("WEP"), Temporal Key Integrity Protocol ("TKIP"), Wi-Fi Protected Access ("WPA"), etc. The connections between the network communications module 245 and the network 290 are, for example, wired connections, wireless connections, or a combination of wireless and wired connections. Similarly, the connections between the controller 200 and the network 290 or the network communications module 245 are wired connections, wireless connections, or a combination of wireless and wired connections. In some embodiments, the controller 200 or network communications module 245 includes one or more communications ports (e.g., Ethernet, serial advanced technology attachment ["SATA"], universal serial bus ["USB"], integrated drive electronics ["IDE"], etc.) for transferring, receiving, or storing data associated with the shovel 10 or the operation of the shovel 10.

The power supply module 235 supplies a nominal AC or DC voltage to the controller 200 or other components or modules of the shovel 10. The power supply module 235 is powered by, for example, a power source having nominal line voltages between 100V and 240V AC and frequencies of approximately 50-60 Hz. The power supply module 235 is also configured to supply lower voltages to operate circuits and components within the controller 200 or shovel 10. In other constructions, the controller 200 or other components and modules within the shovel 10 are powered by one or more batteries or battery packs, or another grid-independent power source (e.g., a generator, a solar panel, etc.).

The user interface module 210 is used to control or monitor the power shovel 10. For example, the user interface module 210 is operably coupled to the controller 200 to control the position of the dipper 38, the position of the boom 22, the position of the dipper handle 26, etc. Further, the user interface module 210 is operably coupled to the controller 200 to request determining of various parameters of the shovel 10 (e.g., the saddle block shimming gap). The user interface module 210 includes a combination of digital and analog input or output devices required to achieve a desired level of control and monitoring for the shovel 10. For example, the user interface module 210 includes a display (e.g., a primary display, a secondary display, etc.) and input devices such as touch-screen displays, a plurality of knobs, dials, switches, buttons, etc. The display is, for example, a liquid crystal display ("LCD"), a light-emitting diode ("LED") display, an organic LED ("OLED") display, an electroluminescent display ("ELD"), a surface-conduction electron-emitter display ("SED"), a field emission display ("FED"), a thin-film transistor ("TFT") LCD, etc. The user interface module 210 can also be configured to display conditions or data associated with the power shovel 10 in real-time or substantially real-time. For example, the user interface module 210 is configured to display measured electrical characteristics of the power shovel 10, the status of the power shovel 10, the position of the dipper 38, the position of the dipper handle 26, the saddle angle between the handle 26 and the saddle block 31, etc. In some implementations, the user interface module 210 is controlled in conjunction with the one or more indicators 205 (e.g., LEDs, speakers, etc.) to provide visual or auditory indications of the status or conditions of the power shovel 10.

The processor 250 of the controller 200 sends control signals to control the operations of the shovel 10. For example, the controller 200 can control, among others, the digging, dumping, hoisting, crowding, and swinging operations of the shovel 10. Further, the controller 200 can analyze various operating parameters of the shovel 10 and can determine when adjustment and/or maintenance is required on specific elements of the shovel 10. In one embodiment, the control signals sent by the controller 200 are associated with request signals to determine various conditions of the shovel 10 or its components. For example, the controller 200 can determine the operational status of the hoist, swing, or crowd motors, a saddle angle, a height of the saddle block, a height of the dipper handle, a hoist rope wrap angle, a hoist motor rotations per minute ("RPM"), a crowd motor RPM, a hoist motor acceleration/deceleration, etc.

The controller 200 and the control system of the shovel 10 described above are used control the operation of the shovel 10. Specifically, the controller 200 is used to determine the saddle block shimming gap of the shovel 10 while the shovel is operating. In one embodiment, the controller 200 is configured to analyze the data received from the saddle angle sensor 35 as the handle 26 passes through an approximately horizontal plane (not shown) that is positioned at 90 degrees in relation to the pivot point 33. As described in more details below, the controller 200 is configured to determine the saddle angle and a saddle angle gap and to use that information to calculate the saddle block shimming gap. After determining the saddle block shimming gap, the controller 200 can provide the saddle block shimming gap to the shovel operator (e.g., by using the user interface module 210). Information about the saddle block shimming gap allows the operator to determine whether the shovel 10 requires immediate maintenance and increases the productivity of the shovel because the shovel does not have to discontinue operation for routine maintenance checks.

Figure 4:
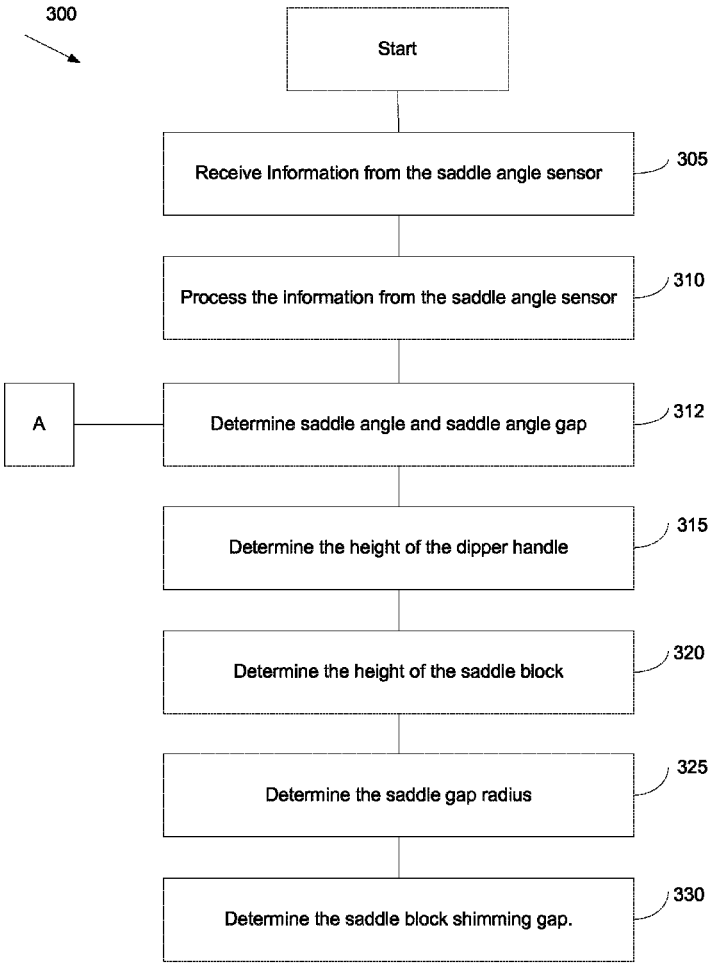
FIG. 4 illustrates a process for determining a saddle block shimming gap of an industrial machine according to an embodiment of the invention

An implementation of the process 300 of controlling the operation of the shovel 10 and determining the saddle block shimming gap for the shovel 10 is illustrated in FIG. 4. The process 300 is associated with, and described herein with respect to, a digging operation and determining the saddle block shimming gap of the shovel 10 during the digging operation. The process 300 is illustrative of an embodiment of a method for determining the saddle block shimming gap and can be executed by the controller 200. Various steps described herein with respect to the process 300 are capable of being executed simultaneously, in parallel, or in an order that differs from the illustrated serial manner of execution. The process 300 is also capable of being executed using additional or fewer steps than are shown in the illustrated embodiment.

Figure 5:
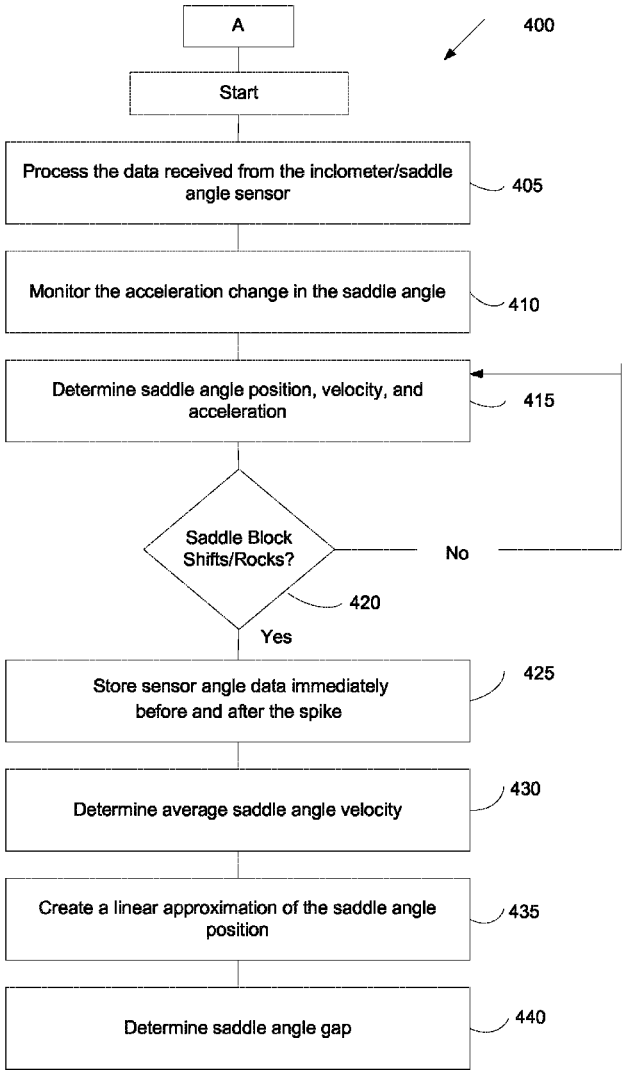
FIG. 5 illustrates additional steps of the process for determining a saddle block shimming gap of an industrial machine.

As shown in FIG. 4, the process 300 begins with receiving information from the saddle angle sensor 35 (at step 305). As mentioned above, in one embodiment, the saddle angle sensor is an inclinometer. After the controller 200 receives the information from the inclinometer 35, the controller processes the information from the saddle angle sensor (at step 310). Next, the controller 200 uses linear calculation (described in more detail below in relation to FIG. 5) to determine the saddle angle and the saddle angle gap as the handle 26 "rocks" or passes through the horizontal plane positioned at 90 degrees in relation to the pivot point 33 (at step 312). The amount of "rock" is dependent on the amount of the shimming gap between the saddle block and the handle. The process of determining the saddle angle and the saddle angle gap is illustrated in FIG. 5 and is described in more detail below. Next, the controller determines the height of the dipper handle 26 (at step 315). In some embodiments, determining the height of the dipper handle 26 is performed by retrieving information from the memory of the shovel 10 (i.e., when the exact height of the dipper handle is stored in the memory). In other embodiments, the controller 200 performs calculations to determine the height of the dipper handle 26. At step 320, the controller 200 determines the height of the saddle block 31. In one embodiment, the height of the saddle block 31 is determined by retrieving information from the memory of the shovel 10. Alternatively, the height of the saddle block 31 can be calculated by the controller 200.

At step 325, the controller 200 determines the radial length of the saddle angle gap (i.e., the saddle gap radius). For example, the saddle gap radius is determined by using information about the handle height and information about the saddle angle gap. In one embodiment, the controller 200 uses the following formula to calculate the saddle gap radius. In the formula below, the saddle gap radius is represented by $r_s$, the handle height is represented by $r_h$ and the saddle angle gap is represented by $\cos(\theta_{gap})$.

$$r_s = \frac{r_h}{\cos(\theta_{gap})}$$

Next, the controller 200 determines the exact saddle block shimming gap $r_{gap}$ by comparing the saddle gap radius $r_s$ with the handle height $r_h$ (at step 330). In one embodiment, the controller uses the following formula to calculate the saddle block shimming gap:

$$r_{gap}=r_s-r_h$$

FIG. 5 illustrates a process 400 for determining the saddle angle and the saddle angle gap for the shovel 10. The process 400 is illustrative of an embodiment of a method for determining the saddle angle and the saddle angle gap and can be executed by the controller 200. Various steps described herein with respect to the process 400 are capable of being executed simultaneously, in parallel, or in an order that differs from the illustrated serial manner of execution. The process 400 is also capable of being executed using additional or fewer steps than are shown in the illustrated embodiment.

As shown in FIG. 5, the process 400 begins with processing and evaluating the information received from the saddle angle sensor 35 (at step 405). In some embodiments, a condition monitor (i.e., software code stored in the memory of the controller 200) identifies when the saddle block 31 shifts forward or backward due to the saddle block shimming gap. This is accomplished by monitoring the acceleration change in the saddle angle (at step 410). In one embodiment, the controller 200 determines saddle angle position, saddle angle velocity, and saddle angle acceleration (at step 415). In particular, the condition monitor of the controller 200 receives information about the saddle angle position from the saddle angle sensor 35 at multiple times during the operation of the shovel. Using the information about the saddle angle position at the various times, the condition monitor performs calculations to determine the saddle angle velocity and the saddle angle acceleration.

θ■Saddle Angle Postion $\dot{\theta}$=Saddle Angle Velocity $\ddot{\theta}$■Saddle Angle Acceleration In the next step, the controller 200 determines when the saddle block shifts or rocks above or below the horizontal plane associated with the pivot point 33 (at step 420). In particular, the condition monitor uses the previously determined saddle angle position, saddle angle velocity, and saddle angle acceleration. As the dipper handle 26 moves across the horizontal plane at a constant hoist velocity, the saddle position maintains a continuous ramp. At the moment the saddle begins to rock, the saddle acceleration increases from zero. Therefore, when the saddle rocks, the acceleration and the velocity of the saddle are larger than the acceleration and the velocity of the shovel. This triggers the condition monitor of the controller 200 to store the sensor angle data (e.g., saddle angle position, saddle angle velocity, and saddle angle acceleration) immediately before and after the spike had occurred in the memory of the shovel (at step 425). The controller 200 determines the average saddle angle velocity at the horizontal plane at the moment when the saddle rocked (at step 430). The controller 200 can also determine the saddle angle velocity above the horizontal plane and the saddle angle velocity below the horizontal plane.

$\theta_h$=Saddle Angle Velocity Above Horizontal Plane $\theta_l$==Saddle Angle Velocity Below Horizontal Plane $\dot{\theta}_{avg}$==Saddle Angle Velocity at the Horizontal Plane Next, the controller 200 uses the average saddle angle velocity at the horizontal plane and the sensor angle data before and after the saddle rock to create a linear approximation of the saddle angle position (at step 435). In one embodiment, the controller 200 uses the equations below to solve the linear approximation (i.e., the saddle angle position) for above (h) and below (1) the horizontal plane.

$$y=mx+b$$

$$\theta \blacksquare \dot{\theta}_{avg}x_b+b_b$$

$$\theta=\dot{\theta}_{avg}x_1+b_1$$

By inserting the stored signal data, the high position approximation data is used to solve the lower position approximation. The calculated difference in the saddle angle position is used to determine the amount of saddle angle gap (at step 440). As explained above, the saddle angle gap is used to determine the saddle block shimming gap. An operator then uses the saddle block shimming gap to determine whether the elements of the saddle block need to be replaced.

$$\theta_{l_h}=\dot{\theta}_{avg}\times x_h+b_l$$

$$\theta_{gap}=\theta_l-\theta_{l_h}$$

Thus, the invention provides, among other things, systems, methods, devices, and computer readable media for determining the saddle block shimming gap for a shovel. Various features and advantages of the invention are set forth in the following claims.

What is claimed is:

1. A method of controlling the operation of an industrial machine, the industrial machine including a boom, a dipper handle attached to the boom, a saddle block pivotally mounted to the boom at a pivot point, and a computer having a controller, the method comprising:

processing, with the controller, data received from a saddle angle sensor;

determining, with the controller, a saddle angle and a saddle angle gap using the data from the saddle angle sensor;

determining, with the controller, a height of the dipper handle;

determining, with the controller, a height of the saddle block;

determining, with the controller, a saddle gap radius; and determining, with the controller, a saddle block shimming gap by comparing the saddle gap radius with the height of the handle.

2. The method of claim 1, wherein the saddle gap radius represents a radial length of the saddle angle gap, and wherein the saddle gap radius is determined by using information about the height of the dipper handle and information about the saddle angle gap.

3. The method of claim 1, wherein the saddle angle is the angle that the saddle block is currently at with respect to the boom.

4. The method of claim 1, wherein processing the data received from the saddle angle sensor is performed at the time the handle passes through an approximately horizontal plane that is positioned at 90 degrees in relation to the pivot point.

5. The method of claim 1, wherein determining the height of the dipper handle includes retrieving information from a non-transitory computer readable medium of the industrial machine.

6. The method of claim 1, wherein determining the height of the dipper handle includes performing calculations with the controller.

7. The method of claim 1, wherein determining the height of the saddle block includes retrieving information from a non-transitory computer readable medium of the industrial machine.

8. The method of claim 1, wherein determining the saddle angle and the saddle angle gap includes:

processing, with the controller, data received from the saddle angle sensor;

monitoring, with a condition monitor of the controller, an acceleration change in the saddle angle; and determining, with the controller, a saddle angle position, a saddle angle velocity, and a saddle angle acceleration.

9. The method of claim 8, wherein determining the saddle angle and the saddle angle gap further includes:

determining, with the controller, when the saddle block shifts above or below a horizontal plane of the pivot point;

storing, with the controller, sensor angle data immediately before and after the shift of the saddle block;

determining an average saddle angle velocity at the horizontal plane at the time the saddle block shifted;

creating a linear approximation of the saddle angle position by using the average saddle angle velocity and the sensor angle data before and after the saddle block shift;

calculating a difference in the saddle angle position; and determining the saddle angle gap using the difference in the saddle angle position.

10. The method of claim 1, further comprising sending information about the saddle block shimming gap to an operator of the industrial machine.

11. An industrial machine comprising:

a boom;

a dipper handle attached to the boom;

a saddle block pivotally mounted to the boom at a pivot point; and a computer having a controller, the controller executing programmed instructions to:

process data received from a saddle angle sensor, determine a saddle angle and a saddle angle gap using the data from the saddle angle sensor, determine a height of the dipper handle, determine a height of the saddle block, determine a saddle gap radius, and determine a saddle block shimming gap by comparing the saddle gap radius with the height of the handle.

12. The industrial machine of claim 11, wherein the saddle gap radius represents a radial length of the saddle angle gap, and wherein the controller executes programmed instructions to determine the saddle gap radius by using information about the height of the dipper handle and information about the saddle angle gap.

13. The industrial machine of claim 11, wherein the saddle angle is the angle that the saddle block is currently at with respect to the boom.

14. The industrial machine of claim 11, wherein the controller executes programmed instructions to process the data received from the saddle angle sensor at the time the handle passes through an approximately horizontal plane that is positioned at 90 degrees in relation to the pivot point.

15. The industrial machine of claim 11, wherein the controller executes programmed instructions to determine the height of the dipper handle by retrieving information from a non-transitory computer readable medium of the industrial machine.

16. The industrial machine of claim 11, wherein the controller executes programmed instructions to determine the height of the dipper handle by performing calculations.

17. The industrial machine of claim 11, wherein the controller executes programmed instructions to determine the height of the saddle block by retrieving information from a non-transitory computer readable medium of the industrial machine.

18. The industrial machine of claim 11, wherein the controller further executes programmed instructions to:

process data received from the saddle angle sensor;

monitor an acceleration change in the saddle angle; and determine a saddle angle position, a saddle angle velocity, and a saddle angle acceleration.

19. The industrial machine of claim 11, wherein the controller further executes programmed instructions to:

determine when the saddle block shifts above or below a horizontal plane of the pivot point;

store sensor angle data before and after the shift of the saddle block;

determine an average saddle angle velocity at the horizontal plane at the time the saddle block shifted;

create a linear approximation of the saddle angle position by using the average saddle angle velocity and the sensor angle data before and after the saddle block shift;

calculate a difference in the saddle angle position; and determine the saddle angle gap using the difference in the saddle angle position.

20. A method controlling the operation of an industrial machine, the industrial machine including a boom, a dipper handle attached to the boom, a saddle block pivotally mounted to the boom at a pivot point, and a computer having a controller, the method comprising:

processing, with the controller, data received from a saddle angle sensor;

determining, with the controller, a saddle angle and a saddle angle gap using the data from the saddle angle sensor;

determining, with the controller, when the saddle block shifts above or below a horizontal plane of the pivot point;

storing, with the controller, sensor angle data immediately before and after the shift of the saddle block;

determining an average saddle angle velocity at the horizontal plane at the time the saddle block shifted;

creating a linear approximation of the saddle angle position by using the average saddle angle velocity and the sensor angle data before and after the saddle block shift;

determining, with the controller, a height of the dipper handle;

determining, with the controller, a height of the saddle block;

determining, with the controller, a saddle gap radius; and determining, with the controller, the saddle block shimming gap by comparing the saddle gap radius with the height of the handle.

* * * * *